United States Patent [19]

Pearce

[11] Patent Number: 4,700,680

[45] Date of Patent: Oct. 20, 1987

[54] TWO STAGE FUEL PUMP

[75] Inventor: P. Glenn Pearce, Mobile, Ala.

[73] Assignee: Teledyne Industries, Inc., Los Angeles, Calif.

[21] Appl. No.: 608,175

[22] Filed: May 8, 1984

[51] Int. Cl.[4] ..... F02M 39/00

[52] U.S. Cl. ..... 123/383; 123/459; 417/252; 417/253; 417/308; 417/310

[58] Field of Search ..... 417/252, 253, 286, 288, 417/308, 310; 123/382, 383, 459, 463

[56] References Cited

U.S. PATENT DOCUMENTS

| | | | |
|---|---|---|---|
| Re. 27,069 | 2/1971 | Roosa | 417/253 |
| 1,689,673 | 10/1928 | Lalor | 417/253 |
| 1,760,070 | 5/1930 | Kinsella | 417/253 X |
| 2,136,959 | 11/1938 | Winfield | 417/308 X |
| 2,180,400 | 11/1939 | Coberly | 417/286 X |
| 2,426,153 | 8/1947 | Mock | 123/463 X |
| 3,680,980 | 8/1972 | Bost | 417/253 |
| 4,208,871 | 6/1980 | Riple | 417/252 X |
| 4,474,158 | 10/1984 | Mowbray | 123/459 X |

*Primary Examiner*—Carlton R. Croyle

*Assistant Examiner*—Theodore W. Olds

*Attorney, Agent, or Firm*—Gifford, Groh, VanOphem, Sheridan, Sprinkle and Dolgorukov

[57] ABSTRACT

The present invention provides a two stage fuel pump which is particularly suited for piston aircraft engines. The fuel pump includes a housing having a fuel inlet and a fuel outlet where the fuel inlet is open to a cylindrical swirl chamber formed in the housing. The first pump stage has its inlet open to the inlet chamber and its outlet open to an intermediate chamber formed in the housing. The second pump stage has its inlet open to the intermediate chamber while its outlet is fluidly connected through a fuel control valve to the fuel outlet. A pressure responsive valve is fluidly connected between the intermediate chamber and inlet chamber and recirculates fuel from the intermediate chamber and to the inlet chamber whenever the pressure in the intermediate chamber exceeds a predetermined pressure. In addition, the fuel control valve is responsive to an engine condition, such as a turbo charger outlet pressure, to variably recirculate a portion of the fuel from the second stage pump outlet to the inlet chamber.

6 Claims, 5 Drawing Figures

TWO STAGE FUEL PUMP

BACKGROUND OF THE INVENTION

I. Field of the Invention

The present invention relates to fuel pumps for aircraft engines and, more particularly, to such pump having two pumping stages.

II. Description of the Prior Art

The previously known fuel pumps for piston aircraft engines typically employ a single stage fuel pump in order to supply fuel to the engine. These fuel pumps, while adequate at low altitude, provide insufficient fuel to the engine at higher altitudes due to high negative inlet pressure as well as vapor formation of the fuel. The high negative inlet pressure reduces the pump's efficiency while the vapor displaces the fuel, both of which contribute to a lower fuel output from the pump.

In order to supply sufficient fuel to the engine at high altitudes, e.g. altitudes in excess of eighteen thousand feet, the previously known aircraft engines have included an electric boost pump which operates in tandem with the standard fuel pump. These electric boost pumps, when activated at high altitudes, supply additional fuel to the engine in order to supply the engine fuel demands.

The previously known electric boost pumps, however, are disadvantageously expensive and also increase the weight of the aircraft. Furthermore, these previously known electric boost pumps suffer from a relatively short life span when operated for prolonged periods of time thus necessitating frequent and expensive maintainance and/or replacement of the boost pump.

SUMMARY OF THE PRESENT INVENTION

The present invention provides a two stage fuel pump which overcomes all of the above mentioned disadvantages of the previously known aircraft fuel systems.

In brief, the fuel pump of the present invention comprises a housing having a fuel inlet open to a cylindrical inlet chamber. The fuel inlet is tangential with respect to the inlet chamber so that the fuel swirls as it enters the inlet chamber. The heavier fuel migrates from centrifugal force to the outer periphery of the inlet chamber while the lighter fuel vapors migrate towards the center of the swirl chamber. These fuel vapors are evacuated from the inlet chamber by a vacuum source.

Two pump stages are rotatably mounted within the housing and are rotatably driven by a power take off by the aircraft engine. The first stage has its inlet connected to the swirl chamber and its outlet connected to an intermediate chamber formed within the pump housing. Similarly, the second pump stage has its inlet connected to the intermediate chamber and its outlet connected through a fuel control valve to the fuel outlet from the pump.

A bypass fluid passageway is formed within the fuel pump housing between the intermediate chamber and the inlet chamber. A pressure responsive valve is operatively connected at the midpoint of this bypass passageway and opens only when the fuel pressure in the intermediate chamber exceeds a predetermined pressure, e.g. 5 psi. Consequently, by variably recirculating a portion of the fuel from the intermediate chamber and back to the inlet or swirl chamber, the pressure within the intermediate chamber is maintained at the predetermined pressure.

The fuel control valve is responsive to an engine condition, such as the pressure output from an engine turbocharger, to variably direct a portion of the fuel output from the second stage to the inlet or swirl chamber or to the pump outlet. Thus, as the engine fuel demand increases, the fuel control valve diverts a greater portion of the fuel from the second pump stage to the fuel outlet and a lesser portion of the fuel is recirculated to the pump inlet. Conversely, when the engine fuel demand decreases, the fuel control valve diverts a greater portion of the fuel to the swirl chamber and a lesser portion of the fuel to the pump outlet.

A pressure relief valve is also fluidly connected in series between the fuel control valve and the swirl chamber. This relief valve is normally maintained in an open condition due to the fuel pressure so that the fuel flowing into the relief valve flows into the inlet chamber. Conversely, during an idle engine condition, the relief valve substantially closes thus forcing fuel to the fuel outlet to maintain the fuel supply to the engine during an idle operating condition. A manually operated fuel mixture valve is connected in series with the fuel outlet to enable the pilot to manually vary the engine fuel mixture as desired.

BRIEF DESCRIPTION OF THE DRAWING

A better understanding of the present invention will be had upon reference to the following detailed description, when read in conjunction with the accompanying drawing wherein like reference characters refer to like parts throughout the several views, and in which.

DETAILED DESCRIPTION OF A PREFERRED EMBODIMENT OF THE INVENTION

Figure 1:
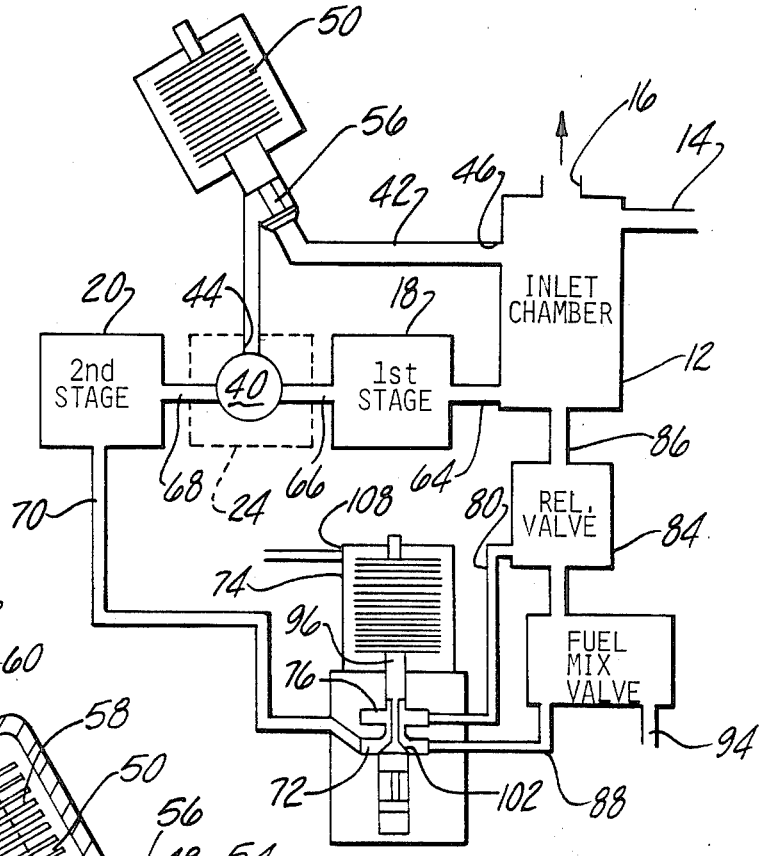
FIG. 1 is a block diagrammatic view illustrating a preferred embodiment of the fuel pump of the present invention.
Figure 2:
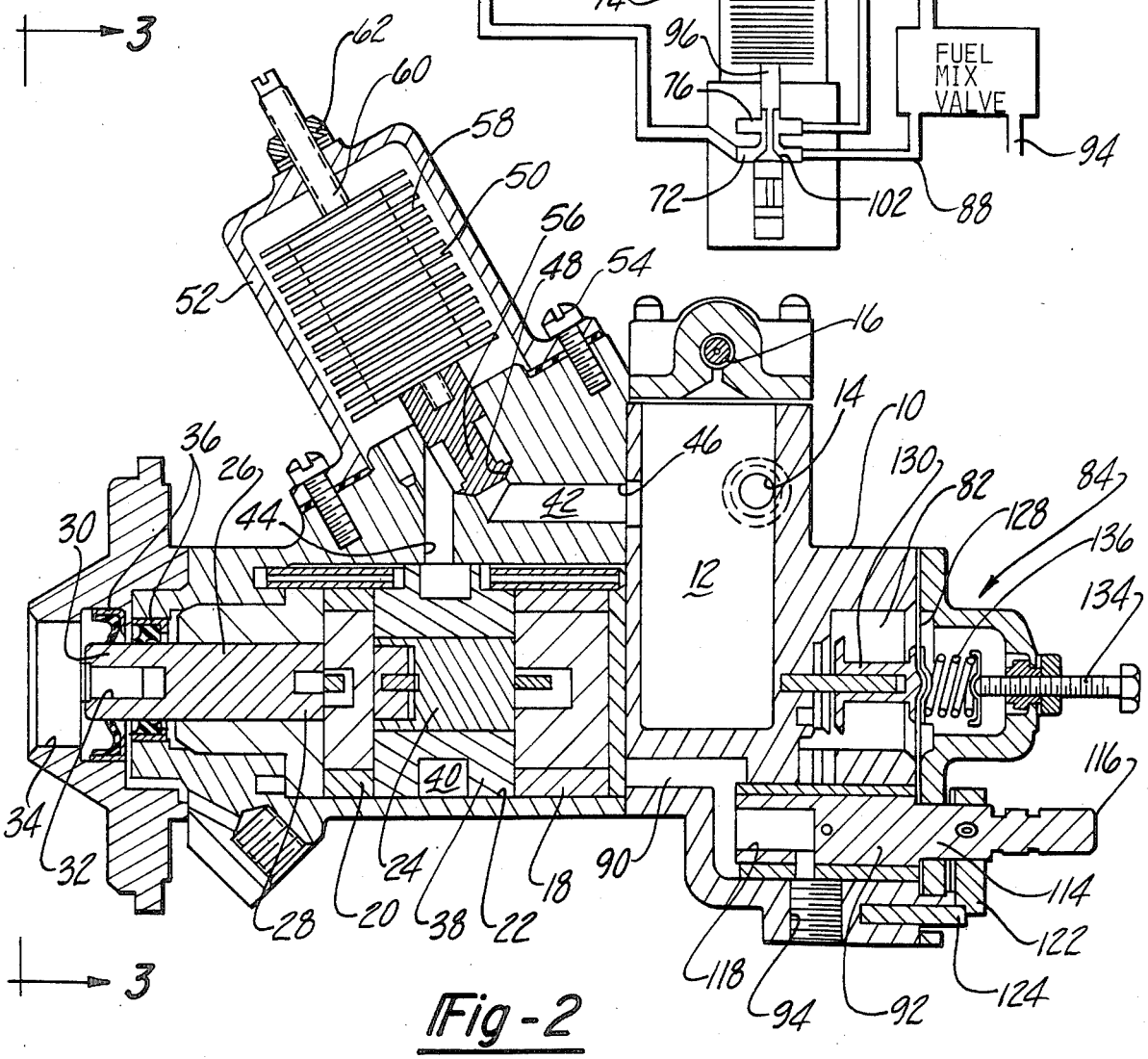
FIG. 2 is a longitudinal sectional view illustrating the preferred embodiment of the invention.

With reference first to FIGS. 1 and 2 a preferred embodiment of the fuel pump of the present invention is thereshown and comprises a fuel pump housing 10 defining a cylindrical inlet or swirl chamber 12. A fuel inlet 14 is open to the inlet chamber 12 and has its axis tangential with respect to the axis of the inlet chamber 12. Consequently, fuel flowing into the housing inlet 14 to the inlet chamber 12 swirls within the chamber 12 so that the inlet chamber 12 forms a swirl chamber.

The swirling action of the fuel within the inlet chamber 12 causes the denser liquid fuel to migrate towards the outer periphery of the chamber 12 from centrifugal force while the lighter fuel vapors migrate toward the central portion of the inlet chamber 12. These fuel vapors are evacuated by a vacuum source (not shown) through a fluid fitting 16 at the upper end of the inlet chamber 12.

A first pumping stage 18 and a second coaxial pumping stage 20 are rotatably mounted within a bore 22 formed in the housing 10 which extends substantially radially outwardly from the axis of the inlet chamber 12. Preferably, the pumping stages 18 and 20 are positive displacement vane pumps with the first stage 18 being larger than the second stage 20.

Figure 3:
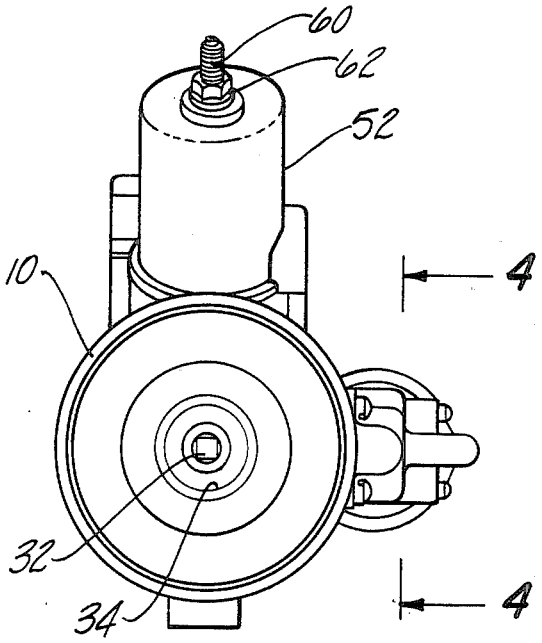
FIG. 3 is an end view of the preferred embodiment of the invention and taken substantially along line 3—3 in FIG. 2.

As best shown in FIGS. 2 and 3, the pump stages 18 and 20 are separated from each other by a spacer 24 which is secured to each pump stage 18 and 20 so that the pump stages 18 and 20 and spacer 24 rotate in unison with each other. A drive shaft 26 is secured at one end 28 to the second pump stage 20 while its other end 30 includes a square bore 32 which is open through an opening 34 in the pump housing 10. A power takeoff (not shown) from the engine is mechanically coupled near the square bore 32 to the shaft 26 to rotatably drive the pump stages 18 and 20. Conventional fluid seals 36 are also provided between the pump housing 10 and the shaft 26 in order to eliminate fuel leakage from the pump.

With reference now to FIG. 2, an annulus 38 is disposed in the housing bore 22 around the spacer 24 and in between the pump stages 18 and 20. This annulus 38 includes a circumferential channel formed on its outer periphery which forms an intermediate annular chamber 40 between the pump stages 18 and 20. A bypass fuel passageway 42 is formed in the pump housing 10 and has one end 44 open to the intermediate chamber 40 and its other end 46 open to the inlet chamber 12. A valve seat 48 is formed at a midpoint of the bypass passageway 42 for a reason to be subsequently described.

A pressure responsive valve assembly 50 is contained within a valve housing 52 and secured to the pump housing 10 by screws 54. The valve assembly 50 includes a valve member 56 which cooperates with the valve seat 48 formed in the bypass passageway 42 to selectively open and close the bypass passageway 42.

The bypass valve assembly 50 preferably comprises an aneroid 58 to which is responsive to the pressure in the intermediate chamber 40. When the pressure in the intermediate chamber 40 exceeds a predetermined amount, for example, 5 psi, the aneroid 58 contracts thus retracting the valve member 56 from its closed position illustrated in FIG. 2 thereby opening the bypass passageway 42. A threaded shaft 60 and nut 62 provides adjustment of the opening pressure of the bypass valve assembly 50.

With reference now particularly to FIG. 1, the inlet of the first stage 18 is connected by a fluid passageway 64 to the inlet chamber 12 while its outlet is connected by a passageway 66 to the intermediate chamber 40. Similarly, the inlet to the second stage 20 is connected by a fluid passageway 68 to the intermediate chamber 40 while the outlet from the second stage 20 is open to an outlet fluid passageway 70. The fluid passageway 64, 66, 68 and 70 are all preferably formed in the pump housing 10.

Figure 4:
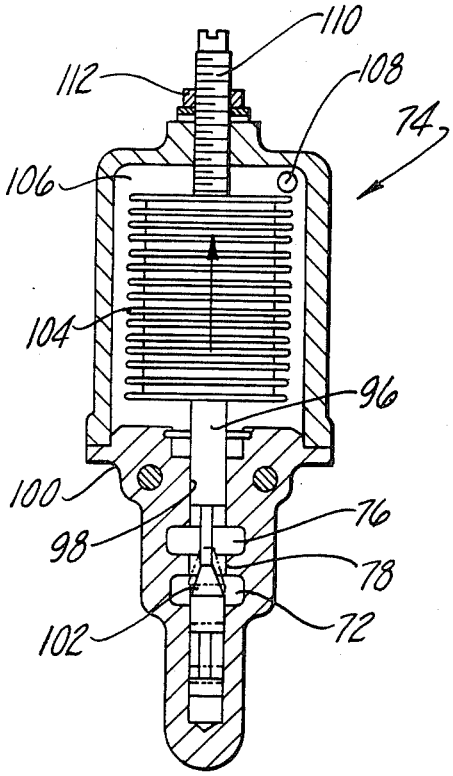
FIG. 4 is a sectional view taken substantially along line 4—4 in FIG. 3, but rotated ninety degrees in the clockwise direction.

With reference now to FIGS. 1, 2 and 4, the passageway 70 from the outlet of the second stage 20 is fluidly connected to the lower chamber 72 of a fuel control valve 74. The valve 74 includes an upper chamber 76 while an orifice 78 interconnects the chambers 72 and 76.

With reference now particularly to FIGS. 1 and 2, the upper chamber 76 of the fuel control valve 74 is fluidly connected by a fluid passageway 80 to a chamber 82 (FIG. 2) in a relief valve assembly 84. During all engine operating conditions, except idle, the fuel pressure in the chamber 82 maintains the relief valve 84 in an open position so that the fuel flowing through passageway 80 flows through the chamber 82 and passageway 86 (FIG. 1) and is returned to the inlet chamber 12. The operation of the relief valve will be subsequently described in greater detail. Conversely, a further passageway 88 fuidly connects the lower chamber 72 of the fuel control valve 74 to a fuel outlet chamber 90 (FIG. 2) formed in the pump housing 10. The fuel outlet chamber 90 is then fluidly connected through a fuel mixture valve 92 to the fuel outlet 94.

With reference again to FIGS. 1 and 4, the fuel control valve 74 comprises a fuel control rod 96 which is slidably mounted within a bore 98 formed in a housing 100 for the valve 74. The fuel control rod 96 includes a frusto-conical portion 102 coaxial with and adjacent the orifice 78 so that axial displacement of the fuel control rod 96 variably restricts the orifice 78 as shown in phantom line in FIG. 4. Thus, with the fuel control rod 96 moved to a raised position, a greater portion of the fuel from the second stage 20 flows through passageway 88 (FIG. 1) and to the outlet chamber 90 (FIG. 2). Conversely, with the fuel control rod 96 shifted to a downward position thus opening the orifice 78, a greater portion of the fuel from the outlet of the second stage 20 is returned to the inlet chamber 12 via the relief valve chamber 82 than is supplied to the fuel outlet 94 through the chamber 90 (FIG. 2).

With reference now particularly to FIG. 4, the position of the fuel control rod 96 is controlled by an aneroid 104 attached to the rod 96. This aneroid 104 is contained within a chamber 106 formed in the valve housing 100. A fluid port 108 is open to the chamber 106 and is fluidly connected to a pressure source indicative of engine speed. Such a pressure source can comprise, for example, a tap to the pressure outlet of an engine turbo charger. Consequently, as the pressure within the chamber 106 increases, the aneroid 104 contracts thus supplying more fuel to the fuel outlet 94. As the pressure within the chamber 106 decreases, indicative of a lower engine speed, the aneroid 104 expands and thus recirculates a greater portion of the fuel back to the inlet chamber 12. A threaded shaft 110 and nut 112 enable adjustment of the initial position of the fuel control rod 96 and thus of the amount of fuel recirculation.

Figure 5:
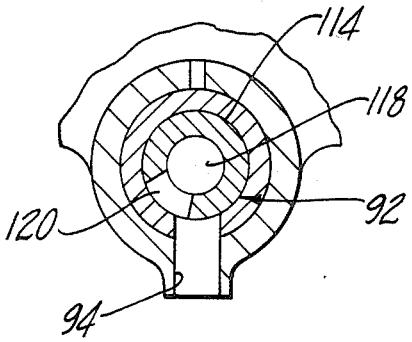
FIG. 5 is a view taken substantially along line 5—5 in FIG. 2.

With reference now particularly to FIGS. 2 and 5, the fuel mixture valve 92 allows the pilot to manually enrich or lean the fuel supply to the engine. The fuel mixture valve 92 includes a body 114 which is rotatably mounted to the pump housing 10 so that one end 116 is accessible to the pilot. A bore 118 is formed in the opposite end of the body 114 which is open to the outlet chamber 90 while a slot 120 formed in the body 114 registers with and thus interconnects the bore 118 with the fuel outlet 94. As best shown in FIG. 5, rotation of the body 114 selectively increases or decreases the area of registration between the slot 120 and the fuel oulet 94 to thereby variably restrict the fuel flow from the outlet chamber 90 and to the pump oulet 94. As shown in FIG. 2, a stop 122 secured to the body 114 in conjunction with a stop pin 124 attached to the pump housing 10 limits the extent of rotation of the fuel control valve body 114 between a full rich and a full lean position.

With reference now to FIG. 2, the relief valve assembly 84 includes a diaphragm 128 attached to a relief valve member 130. At all engine operating conditions, other than idle, the fuel pressure in the relief valve chamber 82 acting upon the diaphragm 128 maintains the relief valve member 130 in its open position depicted in FIG. 2. In its open position, substantially all of the fuel flow into the relief valve chamber 82 is returned to the inlet chamber 12 through the passageway 86 (FIG. 1).

Conversely, during an idle engine condition, the pressure in the relief valve chamber 82 is insufficient to retain the relief valve member 130 in its open position so that the relief valve member 130 shifts leftwardly from its position as shown in FIG. 2. In doing so, the relief valve member 130 substantially closes the fluid passageway 86 (FIG. 1) and creates a back pressure in the fuel passageway 80. This back pressure forces the fuel from the outlet of the second stage 20 through the passageway 88 and to the fuel outlet 94 through the outlet chamber 90 and fuel mixture valve 92. A screw 134 and spring 136 provide adjustment of the relief valve opening pressure.

In operation, at relatively low altitudes the output from the first pump stage 18 is greater than the pressure of the bypass valve assembly 50 so that the bypass valve assembly 50 opens and permits a portion of the fuel from the intermediate chamber 40 to be recirculated or returned to the inlet chamber 12. The remainder of the fuel passes through the second pump stage 20 and fuel control valve 74 which supplies a variable amount of fuel to the engine dependent upon the engine operating requirements. The remainder of the fuel passing through the fuel control valve 74 is returned or recirculated to the inlet chamber 12.

As the engine altitude increases, typically above 18–20 thousand feet, the pressure within the intermediate chamber 40 decreases due to high negative inlet pressure as well as fuel vapor formation. This decrease of pressure within the intermediate chamber 48 causes the bypass valve assembly 50 to move towards its closed position thus restricting or even closing the bypass passageway 42. With the bypass passageway 42 further restricted, or closed, a greater amount of fuel is supplied from the first pump stage 18 and to the second pump stage 20 thereby maintaining sufficient fuel flow to the engine at higher altitudes, e.g. twenty five thousand feet, without the necessity of the previously known electrical boost pumps.

From the foregoing it can be seen that the present invention provides a fuel pump assembly, particularly for a piston aircraft engine, which is capable of maintaining fuel flow to the engine at high altitudes. Having described my invention, however, many modifications thereto will become apparent to those skilled in the art to which it pertains without deviation from the spirit of the invention as defined by the scope of the appended claims.

I claim:

1. A fuel pump for an engine having an engine condition representative of engine speed comprising:

a housing having a fuel inlet and a fuel outlet, said fuel inlet being open to a fuel inlet chamber formed in said housing, a first pump stage having an inlet open to said inlet chamber and an outlet open to an intermediate chamber formed in said housing, a second pump stage having an inlet open to said intermediate chamber and an outlet, wherein said first and second pump stages are vane pump stages and means for coaxially mechanically securing said vane pump stages together for rotation in unison with each other, means for fluidly connecting said second pump stage oulet to said fuel outlet, means for maintaining the pressure in said intermediate chamber below a predetermined maximum amount, wherein said maintaining means comprises means for fluidly connecting said intermediate chamber to said inlet chamber only when the pressure in said intermediate chamber exceeds said predetermined amount means fluidly connected to said second pump stage output and responsive to said engine condition for variably fluidly connecting said second pump stage output to said inlet chamber wherein said variable fluid connecting means comprises a return fluid passageway in said housing fluidly connecting said second stage outlet with said inlet chamber, an orifice in series with and at a midpoint of said return fluid passageway, an outlet fluid passageway fluidly connecting said orifice to said housing outlet, and movable valve means responsive to said engine condition for variably restricting said orifice so that fuel flow from said fluid passageway is variably divided between said return passageway and said outlet passageway as a function of the position of said valve means in amounts inversely proportional to each other.

2. The invention as defined in claim 1 wherein said maintaining means comprises a bypass fluid passageway extending between said intermediate chamber and said inlet chamber, a valve seat forming a fluid port in series with and at a midpoint of said bypass passageway, a valve member movable between a closed position in which said valve member closes said port and an open position in which said valve member is spaced from and opens said fluid port, and pressure responsive means for variably moving said valve member between said open and closed positions.

3. The invention as defined in claim 1 wherein said engine condition comprises a fluid pressure and wherein said valve means comprises a tapered valve axially slidably movable in said orifice, and an aneroid bellows mechanically connected to said tapered valve and responsive to said engine condition.

4. The invention as defined in claim 1 wherein said inlet chamber is substantially cylindrical in shape, comprising means for supplying fuel tangentially to said inlet chamber, and means fluidly connected to one end of said chamber for evacuating vapor from said inlet chamber.

5. The invention as defined in claim 1 and comprising a relief valve having a chamber fluidly connected in series with said orifice and said inlet chamber, said relief valve being movable between an open position in which fluid flow into said relief valve chamber flows into said inlet chamber and a closed position in which said relief valve terminates fluid flow from said relief valve chamber and to said inlet chamber.

6. The invention as defined in claim 2 and comprising a pressure responsive aneroid attached to said valve member.

* * * * *